United States Patent [19]

Veldhuizen

[11] 4,280,588

[45] Jul. 28, 1981

[54] ANTI-POLLUTION MANIFOLD FOR I.C.E.

[76] Inventor: John V. Veldhuizen, 25975 SW. 182nd Ave., Homestead, Fla. 33030

[21] Appl. No.: 79,308

[22] Filed: Sep. 26, 1979

[51] Int. Cl.[3] ..... F01N 7/10

[52] U.S. Cl. ..... 181/240; 60/323

[58] Field of Search ..... 181/238, 240, 255, 264, 181/270, 279–281; 60/282, 323

[56] References Cited

U.S. PATENT DOCUMENTS

| | | | |
|---|---|---|---|
| 980,064 | 12/1910 | Carrick | 181/238 |
| 1,578,839 | 3/1926 | Maple | 181/240 |
| 2,000,722 | 5/1935 | Steward | 181/240 |
| 2,849,859 | 9/1958 | Armstrong | 60/323 |
| 3,768,260 | 10/1973 | Glenn | 181/240 |

FOREIGN PATENT DOCUMENTS

| | | | |
|---|---|---|---|
| 742297 | 3/1933 | France | 181/240 |

*Primary Examiner*—L. T. Hix
*Assistant Examiner*—Thomas H. Tarcza
*Attorney, Agent, or Firm*—Harvey B. Jacobson

[57] ABSTRACT

An elongated hollow body closed at its opposite ends is provided and constucted of high heat resistant metal. The body includes an exhaust gas outlet opening outwardly of one side thereof centrally intermediate its opposite ends and extending in a direction along a path generally normal to and intersecting longitudinal center axis of the body. A plurality of short tubular exhaust gas inlet stubs open outwardly of the opposite side of the body and are spaced therealong from the closed ends and on opposite sides of a transverse plane centered relative to the outlet. The stubs include outer end mounting flange portions supported therefrom similarly inclined generally 20° relative to a plane substantially normal to the stubs, the effective length of the stubs being generally equal to the width thereof. Exhaust gas pressure pulse bisecting partial transverse baffles are mounted within the body spaced from the first mentioned side thereof and also the second mentioned side and at least generally aligned with the ends of the stubs opening into the body.

8 Claims, 4 Drawing Figures

ANTI-POLLUTION MANIFOLD FOR I.C.E.

BACKGROUND OF THE INVENTION

Various forms of anti-pollution exhaust systems recently have been designed to assist in reducing air pollution by the exhaust from internal combustion engines. Most of these systems are designed specifically for use in conjunction with motor vehicles and include fresh air injection into the exhaust ports of internal combustion engines, carburetor and distributor modifications and catalytic converters for serial connection in the exhaust systems of internal combustion engines. However, most of these methods of reducing air pollution by combustion engine exhaust are expensive and require considerable maintenance and/or occasional replacement of various parts thereof. In addition, most of these methods of reducing pollution by exhaust gases from internal combustion engines are used in conjunction with conventional forms of mufflers. Accordingly, a need exists for a substantially trouble free and effective manner of reducing air pollution by exhaust gases from internal combustion engines and one which will not also require a conventional muffler.

Various forms of exhaust gas handling structures including some of the general structural and operational features of the instant invention are disclosed in U.S. Pat. Nos. 2,635,418, 2,849,859, 2,911,006, 3,413,803 and 4,030,465.

BRIEF DESCRIPTION OF THE INVENTION

The exhaust system of the instant invention includes an elongated hollow body constructed of high heat resistant metal such as stainless steel and the hollow body has its opposite ends closed. The hollow body is adapted to extend along an elongated cylinder head having longitudinally spaced exhaust ports opening outwardly therefrom toward the body and one side of the body remote from the associated cylinder head is provided with an exhaust gas outlet opening outwardly from the body centrally intermediate its opposite ends in a direction extending along a path substantially normal to and intersecting with the longitudinal center axis of the body. A plurality of short, tubular exhaust gas inlet stubs open outwardly of the sides of the body remote from the outlet and adjacent the associated cylinder head with the inlet stubs spaced along the tubular body and from the closed ends thereof. In addition, the exhaust inlet stubs are spaced on opposite sides of the transverse plane of the body centered relative to the outlet. The stubs include inlet end mounting flange portions supported therefrom similarly inclined generally 20° relative to a plane generally normal to the exhaust gas inlet stubs and the effective length of the stubs is generally equal to the cross sectional width thereof. Further, the interior of the body includes longitudinally spaced exhaust gas pressure pulse bisecting transverse baffles spaced from the side of the body from which the outlet opens and also from the side of the body into which the exhaust inlet stubs open. The baffles are generally aligned with the ends of the exhaust gas inlet stubs opening into the body.

The main object of this invention is to provide an improved long-life muffler for a multi-cylinder combustion engine constructed in a manner whereby not only will the muffler serve to reduce the sound of the exhaust from the entire but also to reduce the pollution of ambient air by the discharging of exhaust gases from the engine into the ambient air.

Another object of this invention, in accordace with the preceding object, is to provide an anti-pollution exhaust gas muffler constructed in a manner whereby it may be readily adapted for use in conjunction with substantially all forms of multi-cylinder combustion engines and in particular automotive engines.

A further important object of this invention is to provide an exhaust gas muffler constructed in a manner whereby it may be readily incorporated into existing automotive engine installations.

Still another object of this invention is to provide an apparatus in accordance with preceding objects and which will afford little back pressure to the exhaust gases passing therethrough.

A final object of this inventionn to be specifically enumerated herein is to provide an exhaust gas muffler which will conform to conventional forms of manufacture, be of simple construction and dependable in operation so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
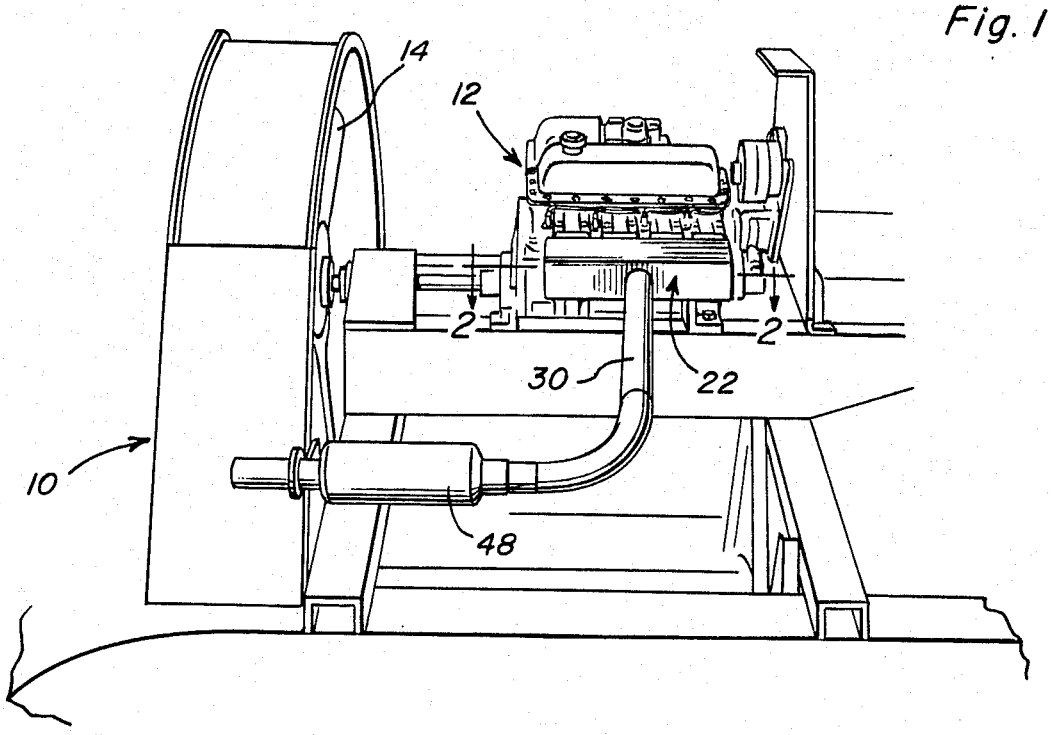
FIG. 1 is a fragmentary perspective view illustrating a conventional automotive type combustion engine mounted within a ground effects vehicle and with the anti-pollution manifold of the instant invention operatively associated therewith.
Figure 2:
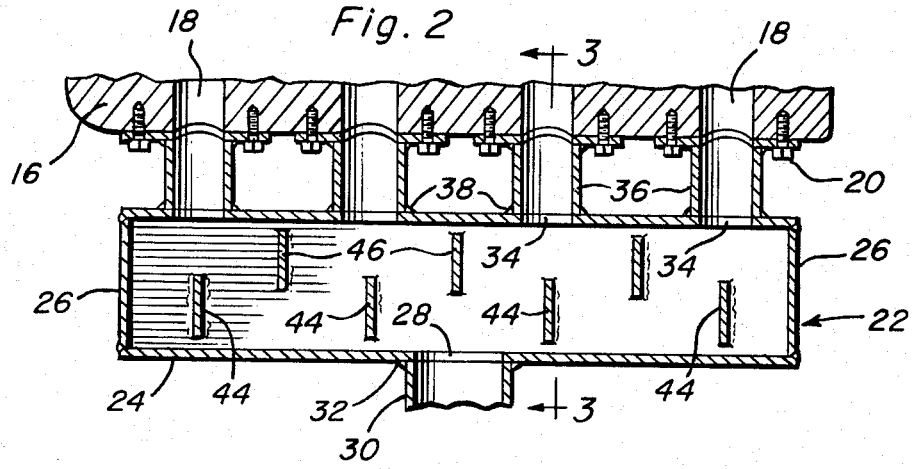
FIG. 2 is a fragmentary enlarged horizontal sectional view taken substantially upon the plane indicated by the section line 2—2 of FIG. 1.

Referring now more specifically to the drawings the numeral 10 generally designates a ground effects vehicle including an automotive type internal combustion engine referred to in general by the reference numeral 12 driving a large diameter propeller assembly 14.

The engine 12 is of the V-8 type and includes a pair of opposite side longitudinally extending cylinder heads 16. Each of the heads 16 includes four exhaust ports 18 opening outwardly thereof and the heads 16 conventionally have automotive type exhaust manifolds (not shown) secured thereto by mounting bolts 20 and including inlet ports registered with the exhuast ports 18.

The anti-pollution manifold of the instant invention is referred to in general by the reference numeral 22 and includes a tubular body 24 constructed of a high heat resistant material such as stainless steel. The body 24 is closed at its opposite ends as at 26 and includes an exhaust gas outlet port 28 formed in one outer side thereof about which the inlet end of an exahust pipe 30 is secured in any convenient manner such as by welding 32. The inner side of the body 24 remote from the exhaust gas outlet port 28 includes four exhaust gas inlet ports 34 formed therein at points spaced longitudinally therealong and each exhaust inlet port 34 has the outlet end of a short tubular exhaust gas inlet stub 36 registered therewith and secured to the corresponding side of the body 24 in any convenient manner such as by welding 38. The exhaust gas inlet stubs 36 have an inside transverse dimension substantially equal to their length and the inlet ends of the stubs 36 have mounting flanges 40 secured thereon. The flanges 40 are apertured as at 42 to receive the usual manifold mounting bolts 20 and are similarly inclined substantially 20° relative to a plane normal to the longitudinal center lines of the tubular stubs 36.

The interior of the body 24 includes two sets of longitudinally spaced partial baffles 44 and 46. The baffles 44 are spaced slightly (generally ¼ inch) from the side of the body 24 in which the exhaust gas outlet port is formed and extend between the upper and lower sides of the body 24 interconnecting the upper and lower marginal edges of the side in which the outlet port 28 is formed and the side in which the inlet ports 34 are formed. The baffles 44 extend slightly past the longitudinal center line of the body 24 toward the side of the body 24 in which the ports 34 are formed and the bafles 44 are equal in number to the ports 34 and aligned with the center lines thereof. The baffles 46 are spaced equally between adjacent baffles 44 and are spaced slightly (approximately ¼ inch) from the side of the body 24 through which the ports 34 open. In addition, the baffles 46 extend toward the remote side of the body 24 slightly past the longitudinal center line thereof and the center baffle 46 is registered with the longitudinal center line of the exhaust gas outlet port 28. Of course, the baffles 46 also extend fully between the upper and lower sides of the body 26.

Although the manifold 22 functions as a muffler and substantially reduces the noise of the exhaust gas being discharged from the engine 12, the pipe 30 may have a muffler 48 mounted on its outlet end if the noise of the exhaust gases being discharged from the engine 12 is to be absolutely minimal.

Inasmuch as the body 24 including the exhaust pipe 30, the exhaust inlet stubs 36, the flanges 40 and the baffles 44 and 46 are constructed of high heat resistant material such as stainless steel, the life of the manifold 22 is expected to be greater than the life of the engine 12 during normal operation thereof.

Figure 3:
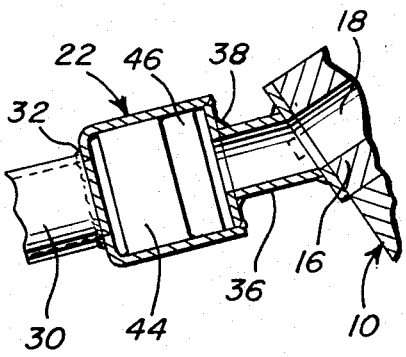
FIG. 3 is a fragmentary transverse vertical sectional view taken substantially upon the plane indicated by the section line 3—3 of FIG. 2.
Figure 4:
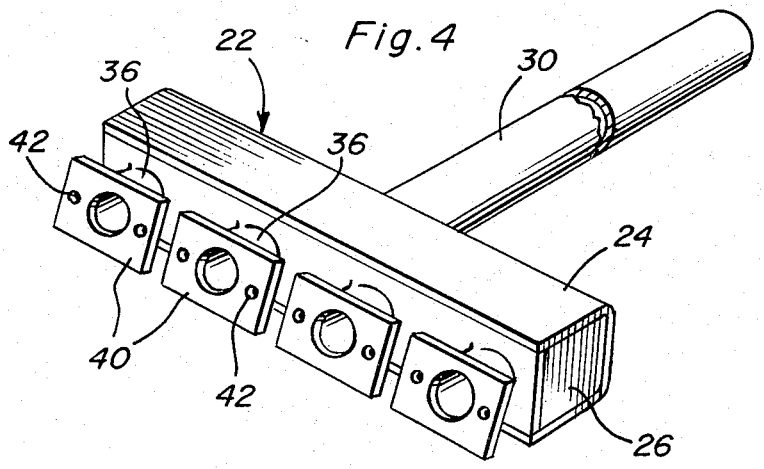
FIG. 4 is a perspective view of the anti-pollution manifold as seen from the exhaust gas inlet side thereof.

Inasmuch as the mounting flanges 40 are inclined approximately 20° relative to a plane normal to the center lines of the stubs 36, the exhaust gas entering the stubs 36 from the ports 18 and thereafter passing into the body 24 is caused to swirl in the body 24 in a counter-clockwise direction as viewed in FIG. 3 of the drawings. The baffles 44 initially bisect the exahust gas pulses entering the body 24 through the ports 34 and cause a portion of the these exhaust gas pulses to be deflected in a reverse direction from the opposing side of the body 24 while some portions of the exhaust gas pulses may pass between the baffles 44 and the adjacent outer wall of the body 24. The exhaust gas pulses are thus initially bisected and blended with each other and thus considerably modulated before passing outwardly through the exhaust gas outlet port 28 into the exhaust pipe 30.

Inasmuch as the manifold 22 is constructed of a high heat resistant material such as stainless steel all components thereof become rapidly heated upon the engine 12 being started and any unburned hydrocarbons within the exhaust gases being discharged from the engine 12 through the ports 18 tend to be burned within the manifold 22. Inasmuch as the unburned hydrocarbons discharged through the ports 18 may be substantially fully burned within the manifold 22, it is unnecessary for the engine 12 to operate on an excessively lean air to fuel mixture ratio and accordingly, the nitrogen oxides level of the exhaust gases entering the manifold 22 is low and further lowered within the manifold.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A combined anti-pollution exhaust manifold and primary muffler for a multi-exhaust port equipped internal combustion engine, said manifold including an elongated hollow body closed at its opposite ends and constructed of high heat resistant metal, said manifold including a single exhaust gas outlet opening outwardly of one side of said body centrally intermediate its opposite ends and in a direction extending along a path substantially normal to and intersecting the longitudinal center axis of said body, a plurality of straight, short, tubular exhaust gas inlet stubs opening outwardly of the side of said body opposite said one side and spaced therealong from said closed ends and on opposite sides of a transverse plane centered relative to said outlet, said stubs including outer inlet end mounting flange portions supported therefrom similarly inclined generally 20° relative to a plane generally normal to said stubs, the effective length of said stubs being generally equal to the width thereof, and exhaust gas pressure pulse bisecting partial transverse baffles in said body spaced from said one side and said opposite side and at least generally aligned with the ends of said stubs opening into said body, said baffles each being generally plate-like in configuration and disposed generally normal to the longitudinal extent of said body.

2. The combination of claim 1 wherein said baffles extend between and are supported from remote sides of said body extending between and connecting said one side and said opposite side of said body.

3. The combination of claim 2 wherein said baffles each are of a dimensional extent extending between said one and opposite sides equal generally to one-half the dimension between said one and opposite sides, said baffles being only slightly spaced from said one side.

4. The combination of claim 3 wherein said body is generally parallelopiped in shape.

5. The combination of claim 3 wherein the spacing of said baffles from said one side is equal, generally, to one-eighth the spacing between said one side and said opposite side.

6. The combination of claim 5 wherein the combined inside transverse dimension of said stubs is slightly less than twice the inside transverse dimension of said body and the transverse dimension of said outlet is greater than the inside transverse dimension of one of said stubs but less than the inside transverse dimension of said body.

7. The combination of claim 1 wherein said body includes a transverse baffle therein generally centered between each pair of adjacent stubs and slightly spaced from said opposite side.

8. The combination of claim 7 wherein the last mentioned baffles extend between and are supported from remote sides of said body extending between and connecting said one side and said opposite side of said body.

* * * * *

UNITED STATES PATENT AND TRADEMARK OFFICE

CERTIFICATE OF CORRECTION

PATENT NO. : 4,280,588

DATED : July 28, 1981

INVENTOR(S) : John Van Veldhuizen

It is certified that error appears in the above-identified patent and that said Letters Patent are hereby corrected as shown below:

On the front or title page, ICIREPAT CODE [76], (inventor's surname), change the initial "V." to --Van--;

same page, under ICIREPAT Code [19], change "Veldhuizen" to --Van Veldhuizen--.

Signed and Sealed this

*Sixth* Day of *October 1981*

[SEAL]

*Attest:*

GERALD J. MOSSINGHOFF

*Attesting Officer*

*Commissioner of Patents and Trademarks*